United States Patent [19]

Jay

[11] 4,119,555

[45] Oct. 10, 1978

[54] DIELECTRIC COMPOSITIONS COMPRISING POLYCHLOROBENZENE-ALKYL TERPHENYL MIXTURES

[75] Inventor: Pierre Jay, Saint-Didier Au Mont D'Or, France

[73] Assignee: Rhone-Poulenc Industries, Paris, France

[21] Appl. No.: 804,738

[22] Filed: Jun. 8, 1977

[30] Foreign Application Priority Data

Jun. 8, 1976 [FR] France ..... 76 18172
Sep. 30, 1976 [FR] France ..... 76 29982

[51] Int. Cl.[2] ..... C10M 3/24; H01B 3/24; H01B 3/22

[52] U.S. Cl. ..... 252/66; 252/63; 336/94

[58] Field of Search ..... 252/66, 63, 78.1; 336/94; 174/17 LF

[56] References Cited

U.S. PATENT DOCUMENTS

| | | | |
|---|---|---|---|
| 1,935,595 | 11/1933 | Clark | 252/78.1 X |
| 2,169,872 | 8/1939 | Clark et al. | 252/66 |
| 2,241,982 | 5/1941 | Clark | 252/66 X |
| 2,413,170 | 12/1946 | Clark | 252/66 X |
| 2,837,724 | 6/1958 | Cook | 252/63 X |
| 2,840,627 | 6/1958 | Lewis | 252/66 X |

*Primary Examiner*—Harris A. Pitlick
*Attorney, Agent, or Firm*—Bacon & Thomas

[57] ABSTRACT

Liquid, non-flammable dielectric compositions especially adapted as insulators/coolants for transformers are comprised of [1] a polychlorobenzene and [2] an alkylaromatic hydrocarbon.

18 Claims, 1 Drawing Figure

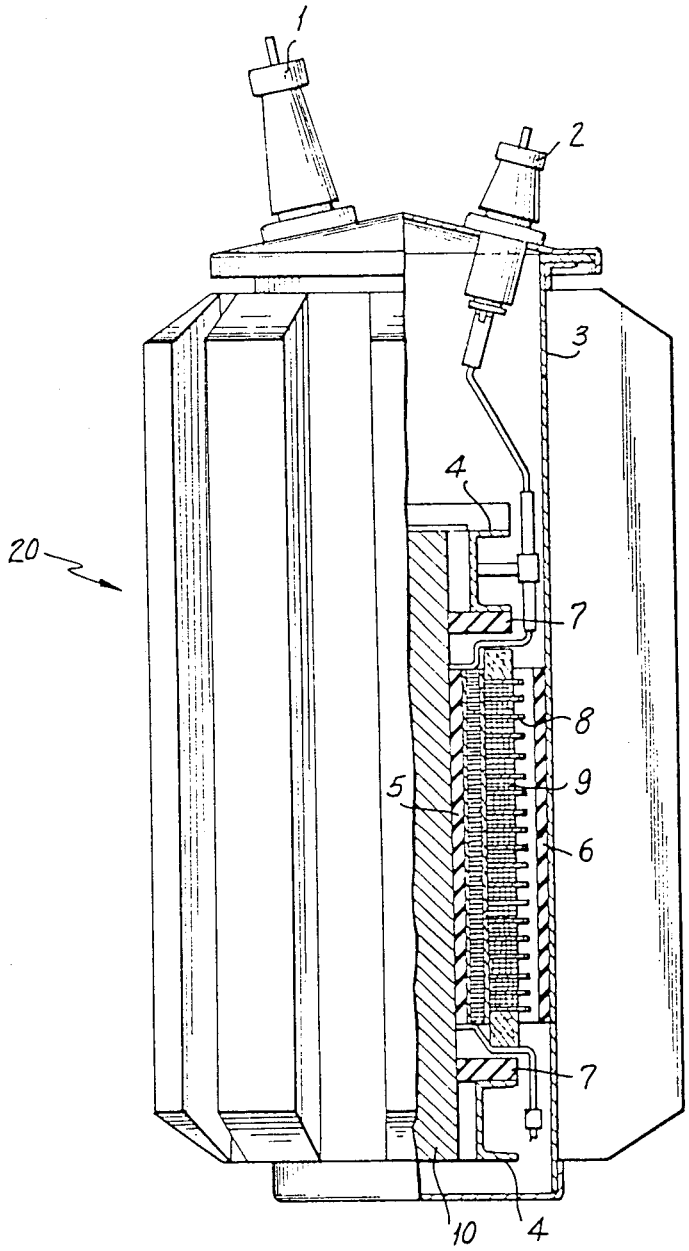
1
2
3
4
20
7
8
9
5
6
7
10
4

DIELECTRIC COMPOSITIONS COMPRISING POLYCHLOROBENZENE-ALKYL TERPHENYL MIXTURES

BACKGROUND OF THE INVENTION

1. Field of the Invention

The present invention relates to novel, liquid, non-flammable dielectric compositions, and, more especially, to such dielectric compositions well suited as insulators/coolants for electrical transformers.

2. Description of the Prior Art

It is art recognized that the dielectric liquids utilized in transformers perform a dual function. On the one hand, they serve as insulating liquids and, in this respect, they must conform to certain pre-determined requirements regarding their electrical properties, especially their dielectric strength and loss factor. On the other hand, they concurrently serve as a cooling agent for the apparatus, and they must thus ensure excellent elimination and dissipation of the heat generated during operation of the transformer. This latter function cannot be successfully fulfilled unless the agent employed exhibits, under the very variable conditions of use of the transformer, a sufficiently low viscosity for the liquid as to enable same to readily dissipate the heat evolved. It is also art recognized that transformers may have to function at extremely low temperatures, for example, below 0° C., and even as low as −40° C. It is thus important that at these extreme temperatures the dielectric should remain a liquid having a sufficient fluidity and should, furthermore, not give rise to complete crystallization, or even to the simple deposition of crystals prone or apt to block or clog the pipelines and pumps which circulate the cooling liquid in certain types of apparatus. Moreover, the presence of crystals too is responsible for a considerable drop in the breakdown voltage, as a result of the electric field heterogeneity which they cause.

In addition to these properties, it is also necessary, for certain types of transformers, that the dielectric liquids should be non-flammable. In fact, under the conditions of operation of the transformers, a destruction of the dielectric can occur, with the production of an electric arc which may be of very high power. This breakdown arc decomposes the liquid or solid dielectrics and can ignite the liquid and/or the gases evolved, whether these are decomposition products of the dielectric or of the vapors thereof. It is thus important that the dielectric liquid and its vapors, or the decomposition gases produced in the event of a fault in operation of the apparatus, should not ignite. In general, this resistance to ignition is assessed in terms of the flash point or the ignition point of the liquid in question.

Numerous liquid dielectrics for transformers which, to a greater or lesser extent, exhibit all of the properties enumerated above have been proposed. Among these products, there may be mentioned the "askarels" which have proved most satisfactory and which are used most widely. Same are biphenyl or terphenyl chlorination products containing from 3 to 7 chlorine atoms, which are most frequently employed in the form of admixture with one other or with other chlorinated aromatic hydrocarbons, and especially with the trichlorobenzenes and tetrachlorobenzenes. In spite of their demonstrated value, these particular dielectrics exhibit the severe disadvantage that they cannot be degraded biochemically and are difficult to degrade chemically. This stability of the polychlorobiphenyls presents serious hazards from an environment pollution standpoint, such that a need is becoming increasingly more evident for products having as short a life as possible, in nature, as a result of being increasingly chemically or biochemically degradable. Such products which exhibit both the aforementioned technical properties, as well as enhanced degradability, were hitherto unknown to the industry.

SUMMARY OF THE INVENTION

It has now been found that certain compositions are especially well adapted as insulator/coolant dielectric liquids for transformers, which dielectrics:

[i] neither crystallize nor do they set solid under typical service conditions; in particular, same do not effect deposits of crystals at temperatures below or equal to −10° C.;

[ii] have a very high flash point which is, in particular, greater than or equal to 130° C., and same do not have an ignition point below their boiling point;

[iii] have a low viscosity under typical conditions of use and, in particular, have a viscosity which is usually below 15 cPo at 60° C.;

[iv] have excellent dielectric properties; and

[v] are degradable in the event of pollution of the environment.

More specifically, the above and other objects of the present invention are attained by providing certain dielectric liquids for transformers, characterized in that same comprise:

[1] from 30 to 80% by weight of a polychlorobenzene selected from the group consisting of the trichlorobenzenes and the tetrachlorobenzenes, which polychlorobenzenes can be used either alone or in admixture with each other, and

[2] from 70 to 20% by weight of an alkylaromatic hydrocarbon selected from the group consisting of the mono- or polyalkylbiphenyls and the mono- or polyalkylterphenyls, in which the alkyl substituent contains from 1 to 5 carbon atoms, or admixtures thereof.

BRIEF DESCRIPTION OF THE DRAWING

The FIGURE of the Drawing is a vertical cross-section, partly in elevation, of a transformer which has been insulated according to the invention.

DETAILED DESCRIPTON OF THE INVENTION

Even more particularly, the alkylaromatic hydrocarbons which can be used in the dielectric compositions according to the invention correspond to those of the following formulae:

(I)

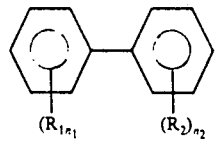

(II)

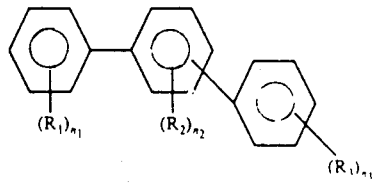

in which:

$R_1$, $R_2$ and $R_3$ represent identical or different linear or branched alkyl radicals containing from 1 to 5 carbon atoms and preferably from 2 to 4 carbon atoms, and $n_1$, $n_2$ and $n_3$, which may be identical or different, represent 0 or a number from 1 to 3, with the proviso that at least one of the indices $n_1$, $n_2$ and $n_3$ is at least equal to 1 and that, in the formula (I) compounds, the sum $n_1 + n_2$ is at most equal to 5 and in the formula (II) compounds the sum $n_1 + n_2 + n_3$ is at most equal to 4.

As specific examples of the radicals $R_1$, $R_2$ and $R_3$, there may be mentioned the methyl, ethyl, n-propyl, isopropyl, n-butyl, isobutyl, t-butyl and n-pentyl radicals. Preferably, $R_1$, $R_2$ and $R_3$ represent the ethyl, propyl and butyl radicals, and, more preferably, the isopropyl and t-butyl radicals.

The alkyldiphenyls and alkylterphenyls comprising the liquid dielectrics according to the invention are known products obtained by alkylation of biphenyls and terphenyls by means of the usual alkylating agents, such as the alkyl halides, the aliphatic olefins containing from 1 to 5 carbon atoms or the alkanols, in the presence of the usual catalysts for Friedel-Crafts reactions. Because of their valuable physical and dielectric properties, these compounds are used as cooling liquids and the use of certain of same as dielectrics has even been proposed [compare U.S. Pat. No. 2,837,724]. However, because of their inflammability, the alkyldiphenyls and alkylterphenyls are not used in practice as non-flammable dielectrics and coolants for transformers.

Depending on their physical state at low temperatures, the alkyldiphenyls and alkylterphenyls can be used in the pure state, or in the form of mixtures of isomers and/or of products with different degrees of alkylation obtained in the course of their preparation. It is, in particular, possible to use the crude mixtures resulting from the alkylation of biphenyl and the terphenyls, which mixtures can, where appropriate, contain the unconverted starting material biphenyl and terphenyl, in addition to the reaction products. In all cases it is preferable that the degree of alkylation of the mixture represented by the number of alkyl groups per molecule is at least 1 and preferably at least 1.5.

Among the alkylbiphenyls and alkylterphenyls which, depending on the particular case, can be used by themselves or as mixtures with one another, the following may be mentioned as non-limiting examples: 2-ethylbiphenyl, 4-ethyl-biphenyl, 4,4'-diethyl-biphenyl, the triethyl-biphenyls, 2-propyl-biphenyl, 4-propyl-biphenyl, 2-isopropyl-biphenyl, 3-isopropyl-biphenyl, 4-isopropyl-biphenyl, 3,3'-dipropyl-biphenyl, 4,4'-dipropyl-biphenyl, 2,2'-di-isopropyl-biphenyl, 4,4'-di-isopropyl-biphenyl, 3,3'-,5,5'-tetraisopropyl-biphenyl, 2-n-butyl-biphenyl, 3-n-butyl-biphenyl, 4-n-butyl-biphenyl, 3-sec-butyl-biphenyl, 4-sec-butyl-biphenyl, 2-t-butyl-biphenyl, 3-t-butyl-biphenyl, 4-t-butyl-biphenyl, 2,2'-di-t-butyl-biphenyl, 4,4'-di-t-butyl-biphenyl, 3,5-di-t-butyl-biphenyl, 4,4'-di-sec-butyl-biphenyl, 2,4,6-tri-t-butyl-biphenyl, 3,3',5,5'-tetra-t-butyl-biphenyl, 4-sec-butyl-4'-t-butyl-biphenyl, sec-butyl-di-t-butyl-biphenyl, 4'-isopropyl-meta-terphenyl, 4'-butyl-meta-terphenyl, 5'-butyl-meta-terphenyl, diisopropyl-meta-terphenyl, 2,2''-diethyl-meta-terphenyl, 2,3''-diethyl-meta-terphenyl, 4,4''-diethyl-meta-terphenyl, tri-isopropyl-meta-terphenyl, 4-isopropyl-ortho-terphenyl, 4-butyl-ortho-terphenyl, di-isopropyl-para-terphenyl, tri-isopropyl-para-terphenyl and 4,4'-dibutyl-para-terphenyl.

It is also possible to use, without departing from the scope of the present invention, the products resulting from the alkylation of mixtures of 2 or of 3 of the isomeric terphenyls. In particular, it is possible to employ mixtures resulting from the isopropylation and the t-butylation of mixtures of two or three isomeric terphenyls or of biphenyl with terphenyls.

The trichlorobenzenes and tetrachlorobenzenes used in the dielectric liquids which constitute the subject of the present invention are known products of melting point above 17° C. In spite of their good dielectric properties and their non-flammability, these chlorobenzenes have not been used in and of themselves as dielectrics because of their excessively high crystallization points. 1,2,4-Trichlorobenzene and 1,2,3,4-tetrachlorobenzene have been used as additives in dielectrics, or in customary cooling liquids, such as polychlorobiphenyls, in order to lower the solidification point [compare Ullman, *Encyclopadie der Technischen Chemie*, 5, page 468 (1954); Kirk-Othmer, *Encyclopedia of Chem. Technology*, 5, page 265 (1964); German Pat. No. 687,712]. The use of mixtures of trichlorobenzenes as dielectric liquids has also been disclosed, but these compositions, which principally comprise 1,2,3-trichlorobenzene and 1,2,4-trichlorobenzene, and small amounts of other chlorobenzenes (dichlorobenzenes and tetrachlorobenzenes) still have crystallization points which are too high for the compositions to be used in transformers. Thus, the eutectic mixture of 1,2,3-trichlorobenzene and 1,2,4-trichlorobenzene, which contains 34% and 66% of the two isomers, respectively, has a crystallization point of + 1.5° C. [compare Ullman, *Encyclopadie der Technischen Chemie*, 9, page 500 (1975)].

Among the trichlorobenzenes and tetrachlorobenzenes which can be used in the compositions defined above, it is preferred to employ 1,2,3- trichlorobenzene and 1,2,4-trichlorobenzene and 1,2,3,4-tetrachlorobenzene. These compounds can be used by themselves or mixed with one another; in the latter case, the proportions of each of the constituents are not critical and can vary within wide limits. For example, in these mixtures each compound can represent from 1 to 99% by weight of the whole. However, for practical reasons it is preferred to use the eutectic mixtures of 1,2,3-trichlorobenzene/1,2,4-trichlorobenzene, or 1,2,3-trichlorobenzene/1,2,4-trichlorobenzene/1,2,3,4-tetrachlorobenzene and the eutectic mixtures formed by tetrachlorobenzene with each of the above-mentioned trichlorobenzenes; whether the above-mentioned trichlorobenzene and tetrachlorobenzene are used by themselves or as mixtures, they can contain a small amount (preferably less than 10% by weight of the whole of the chlorobenzenes) of dichlorobenzenes or of pentachlorobenzenes.

Among the compositions of the present invention, it is preferred to employ those which contain from 35 to 80% by weight of chlorobenzenes and from 65 to 20% of alkylbiphenyls or alkylterphenyls, and, more preferably, from 60 to 80% by weight of chlorobenzenes and from 40 to 20% by weight of alkylbiphenyls or alkylterphenyls. By judicious choice of the respective amounts of the components of the dielectric mixture it is possible to obtain a range of products having all the properties listed, but to varying degrees, and consequently it is possible to regulate to an optimum degree these properties in accordance with the type of non-flammable transformer for which the dielectric is intended. By way of an example, for transformers intended to work under relatively mild climatic conditions (either because these apparatuses are enclosed or because they function in countries having a mild climate), it is not necessary that the dielectric should not effect deposits of crystals at temperatures below or equal to −25° C.; in these cases, a somewhat higher limit on the temperature at which crystals form will be tolerated; this limit may thus be as high as −10° C.

The dielectric compositions described above may contain the usual adjuvants, such as sequestering agents for the hydrochloric acid which may be liberated by decomposition of the chlorobenzenes under the operating conditions of transformers. The sequestering agents for hydrochloric acid which are employed preferably are epoxy compounds, such as those typically employed in the field of chlorinated dielectrics, among which the following may be mentioned as non-limiting examples: propylene oxide and glycidyl ethers; styrene oxide, 1,3-bis-(2,3-epoxy-propoxy)-benzene and di(2-ethylhexyl) 4,5-epoxy-tetrahydrophthalate. Other epoxy compounds, such as those noted in U.S. Pat. Nos. 3,362,708, 3,242,401, 3,242,402 and 3,170,986 may be used.

The amount of sequestering agent incorporated into the dielectric can vary within wide limits. In general, an amount of between 0.01 and 5% by weight of the mixture of chlorobenzenes and alkyldiphenyl or alkylterphenyl is very suitable.

The compositions according to the invention can be used for all types of transformers. The FIGURE of Drawing schematically illustrates an apparatus 20 in which the dielectric mixtures described above can be employed. The transformer represented in this FIGURE comprises a high tension terminal 1, a low tension terminal 2, the transformer cell 3, clamping flanges 4, and insulating barriers 5 and 6 which respectively separate the low voltage winding 8 and the magnetic core 10, on the one hand, and the high voltage winding 9 and the transformer cell 3 on the other. The components 7 represent insulating spaces. The conductors of the low voltage and high voltage windings are insulated by a solid dielectric material, such as paper.

The transformer cell is filled with the dielectric composition. The liquid fills all the cavities and impregnates the windings and other parts of the apparatus capable of being impregnated.

In order to further illustrate the present invention and the advantages thereof, the following specific examples are given, it being understood that same are intended only as illustrative, and in nowise limitative. In these examples, the flash point and the ignition point were determined in accordance with standard specification ASTM D 92-66, using the Cleveland open cell method.

EXAMPLE 1

A dielectric composition for transformers was prepared by mixing:

[1] 50 parts by weight of a ternary eutectic mixture comprising 20.3% of 1,2,3-trichlorobenzene, 47.3% of 1,2,4-trichlorobenzene and 32.4% of 1,2,3,4-tetrachlorobenzene, which will hereinafter be referred to as MET; and

[2] 50 parts by weight of a mixture of isomeric triisopropyl-biphenyls (TIPB) obtained by isopropylation of biphenyl, and the physical characteristics of this composition and, by way of comparison, those of the constituents of said mixture, were then determined. The results shown in the table which follows were obtained:

TABLE I

| PROPERTIES | PRODUCTS MET | TIPB | MET + TIPB |
|---|---|---|---|
| Boiling point | 228° C. | 326° C. | 255° C. |
| Flash point | 126° C. | 178° C. | negative |
| Ingition point | negative | 192° C. | negative up to boil |
| Viscosity at 60° C. in cPo | 1.5 | 15 | 4 |
| Crystallization at −25° C. (1) | total | zero | partial |
| Melting point of the last resultant crystals | −9° C. | — | −22° C. |

(1) The crystallization at 25° C. was determined by cooling the tested product to −40° C., then seeding it with traces of crystals of trichlorobenzenes, and stirring the seeded mixture. The latter was then subjected to cooling and reheating cycles between −40 and −30° C. and, ultimately, the sample was reheated progressively and the presence or absence or crystals at a tempeerature of −25° C. was noted, as was the melting point of the last resultant crystals.

EXAMPLE 2

A mixture containing 45% by weight of MET and 55% by weight of TIPB was prepared. This composition had the following properties:

| | |
|---|---|
| Boiling point | 260° C. |
| Flash point | 132° C. |
| Ignition point | negative up to boil |
| Viscosity at 60° C. in cPo | 4.5 |
| Crystallization at −25 ° C. | zero |

EXAMPLE 3

A dielectric mixture having the following composition was prepared:

[1] 35% by weight of MET; and

[2] 65% by weight of a mixture of isopropylterphenyls containing an average of 2.3 isopropyl groups per molecule and obtained by isopropylation of a mixture of ortho-, meta- and para-terphenyls (respectively 11%, 62% and 25% by weight), hereafter referred to as DIPT.

The same determinations were carried out on this mixture as in Example 1. The results obtained are shown in the table which follows:

TABLE II

| PROPERTIES | PRODUCTS DIPT | DIPT + MET |
|---|---|---|
| Boiling point | 384° C. | 260° C. |
| Flash point | 218° C. | 158° C. |
| Ignition point | 252° C. | negative up to boil |
| Viscosity at 60° C. in cPo | 150 | 14.3 |
| Crystallization at −25° C. | negative | negative |

EXAMPLE 4

A dielectric liquid having the following composition was prepared:

[1] 40% by weight of MET; and

[2] 60% by weight of ethylterphenyls containing 1.7 ethyl groups per molecule, obtained by ethylation of a mixture of ortho- and meta-terphenyl (DET).

The same determinations were carried out on this mixture as in Example 1. The results are as follows:

TABLE III

| PROPERTIES | PRODUCTS DET | DET + MET |
|---|---|---|
| Boiling point | | 300° C |

TABLE III-continued

| PROPERTIES | PRODUCTS DET | DET + MET |
|---|---|---|
| Flash point | 206 | 146° C. |
| Ignition point | 240 | negative up to boil |
| Viscosity at 60° C. in cPo | 28 | 6.5 |
| Crystallization at −25° C. | negative | negative |

EXAMPLE 5

Two dielectric liquids were prepared by mixing:

[1] a t-butylbiphenyl having a degree of alkylation of 1.6 (1.6 t-butyl groups per molecule), which is a mixture of mono- and di-t-butylbiphenyl. It will hereafter be referred to as TBB.

[2] MET, in the following proportions:

Composition 1: 50% by weight of TBB and 50% by weight of MET

Composition 2: 45% by weight of TBB and 55% by weight of MET

Thereafter the flash point and ignition point of these compositions were determined. The following results were obtained:

TABLE IV

| PROPERTIES | COMPOSITIONS A | B |
|---|---|---|
| Boiling point | 250° C. | 250° C. |
| Flash point | 136° C. | 138° C. |
| Ignition point | negative up to boil | negative up to boil |

EXAMPLE 6

A dielectric liquid which did not effect deposit of any crystals in the crystallization test at −25° C. and which had a viscosity of 12 cPo at 60° C. was prepared by mixing:

[1] 60 parts by weight of isopropylterphenyl (IPT) obtained from a mixture of ortho-, meta- and para-terphenyl and containing 2.5 isopropyl groups per molecule of terphenyl, and

[2] 40 parts by weight of a mixture of chlorobenzenes containing:

a. 1,2,3-trichlorobenzene: 19% by weight b. 1,2,4-trichlorobenzene: 44% by weight c. 1,2,3,4-tetrachlorobenzene: 37% by weight

EXAMPLE 7

A dielectric liquid which did not effect deposit of any crystals in the crystallization test at −25° C. and which had a viscosity of 13 cPo at 60° C. was prepared by mixing:

[1] 64% by weight of IPT, as used in Example 6, and

[2] 36% by weight of MET.

EXAMPLE 8

A dielectric composition for transformers was prepared by mixing:

[1] 80% by weight of a ternary eutectic mixture containing 20.3% by weight of 1,2,3-trichlorobenzene, 47.3% by weight of 1,2,4-trichlorobenzene and 32.4% by weight of 1,2,3,4-trichlorobenzene, and

[2] 20% by weight of an ethylterphenyl containing an average of 1.3 ethyl groups per molecule of terphenyl, obtained by ethylation of a mixture containing 22% by weight of ortho-terphenyl, 75% by weight of meta-terphenyl and 3% by weight of para-terphenyl.

The formation of crystals in this mixture was brought about by cooling to a temperature below −10° C. and then seeding with traces of crystals of trichlorobenzenes, after which the mixture was progressively reheated and the temperature at which the last resultant crystals disappear was noted; it being −12° C. in the present case.

EXAMPLE 9

A liquid dielectric composition as in Example 8 was prepared by replacing the ethylterphenyl or monoisopropylterphenyl obtained by isopropylation of the same mixture of terphenyls as in Example 8.

The melting point of the last resultant crystals was between −15° and −12° C.

While the invention has been described and illustrated with reference to certain preferred embodiments thereof, those skilled in the art will appreciate that various changes, modifications and substitutions therein can be made without departing from the spirit of the invention. It is intended, therefore, that the invention be limited only by the scope of the claims which follow.

What is claimed is:

1. A liquid, non-flammable dielectric composition, comprising (1) a polychlorobenzene selected from the group consisting of a trichlorobenzene, a tetrachlorobenzene, and mixtures thereof, and (2) a mono- or polyalkylterphenyl, and mixtures thereof, wherein each alkyl substituent contains from 1 to 5 carbon atoms.

2. The dielectric composition as defined by claim 1, comprising from 30 to 80% by weight of the component (1), and from 70 to 20% by weight of the component (2).

3. The dielectric composition as defined by claim 2, wherein the component (1) comprises a member selected from the group consisting of 1,2,3-trichlorobenzene, 1,2,4-trichlorobenzene, 1,2,3,4-tetrachlorobenzene and mixtures thereof.

4. The dielectric composition as defined by claim 3, wherein the component (1) is a eutectic mixture of 1,2,3-trichlorobenzene and 1,2,4-trichlorobenzene.

5. The dielectric composition as defined by claim 3, wherein the component (1) is the ternary eutectic mixture of 1,2,3-trichlorobenzene/1,2,4-trichlorobenzene/1,2,3,4-tetrachlorobenzene.

6. The dielectric composition as defined by claim 1, wherein the component (2) comprises a terphenyl having the structural formula:

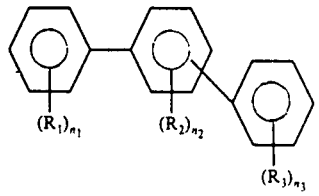

(II)

in which $R_1$, $R_2$, and $R_3$ represent identical or different linear or branched chain alkyl radicals containing from 1 to 5 carbon atoms, and $n_1$, $n_2$, and $n_3$, which may be identical or different, represent 0 or a number ranging from 1 to 3, with the proviso that the sum $n_1 + n_2 + n_3$ is at most equal to 4.

7. The dielectric composition as defined by claim 1, wherein the terphenyl component (2) comprises a member selected from the group consisting of mixtures of isomers, alkyl terphenyls having different degrees of alkylation, and admixtures thereof.

8. The dielectric composition as defined by claim 1, wherein the terphenyl component (2) comprises mixtures obtained by alkylation of terphenyls, which mixtures optionally containing a proportion of unconverted starting material hydrocarbons.

9. The dielectric composition as defined by claim 8, wherein the degree of alkylation of the mixtures expressed by the number of alkyl groups per molecule of terphenyl is at least 1.

10. The dielectric composition as defined by claim 6, wherein each $R_1$, $R_2$, $R_3$ is selected from the group consisting of methyl, ethyl, n-propyl, isopropyl, n-butyl, isobutyl, sec-butyl and t-butyl.

11. The dielectric compositon as defined by claim 1, further comprising a sequestering agent.

12. The dielectric composition as defined by claim 11, wherein the sequestering agent is an epoxy compound.

13. The dielectric composition as defined by claim 12, wherein the epoxy compound is a compound selected from the group consisting of propylene oxide, glycidyl ethers, styrene oxide, 1,3-bis-(2,3-epoxy-propoxy)-benzene and di(2-ethylhexyl)-4,5-epoxy-tetrahydrophthalate.

14. The dielectric composition as defined by claim 1, comprising from 35 to 80% by weight of the component (1), and from 65 to 20% by weight of the component (2).

15. The dielectric composition as defined by claim 1, comprising from 60 to 80% by weight of the component (1), and from 40 to 20% by weight of the component (2).

16. The dielectric composition as defined by claim 1, which does not effect deposition of crystals at temperatures of less than about −10° C., has a flash point at least as high as about 130° C., does not have an ignition point below its boiling point, and is degradable.

17. The dielectric composition as defined by claim 16, having a viscosity of less than about 15 centipoises at 60° C.

18. In a transformer, the improvement which comprises insulation/coolant material comprising the dielectric composition as defined by claim 1.

* * * * *